US008676558B2

(12) United States Patent
Pirovolou

(10) Patent No.: US 8,676,558 B2
(45) **Date of Patent: *Mar. 18, 2014**

(54) METHOD OF AUTOMATICALLY CONTROLLING THE TRAJECTORY OF A DRILLED WELL

(75) Inventor: Dimitros K. Pirovolou, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/101,823

(22) Filed: May 5, 2011

(65) Prior Publication Data

US 2011/0213601 A1 Sep. 1, 2011

Related U.S. Application Data

(63) Continuation of application No. 11/770,954, filed on Jun. 29, 2007, now Pat. No. 7,957,946.

(51) Int. Cl.

| | |
|---|---|
| ***G06G 7/58*** | (2006.01) |
| ***G01V 1/40*** | (2006.01) |
| ***G01V 3/18*** | (2006.01) |
| ***G01V 5/04*** | (2006.01) |
| ***G01V 9/00*** | (2006.01) |

(52) U.S. Cl.
USPC ..... 703/10; 702/9

(58) Field of Classification Search
USPC ..... 703/10; 702/9
See application file for complete search history.

(56) References Cited

U.S. PATENT DOCUMENTS

| | | | | |
|---|---|---|---|---|
| 4,662,458 | A | 5/1987 | Ho | |
| 4,733,733 | A | 3/1988 | Bradley et al. | |
| 4,794,534 | A * | 12/1988 | Millheim | 702/9 |
| 4,804,051 | A | 2/1989 | Ho | |
| 6,021,377 | A | 2/2000 | Dubinsky et al. | |
| 6,101,444 | A | 8/2000 | Stoner | |
| 6,155,357 | A | 12/2000 | King et al. | |
| 6,233,524 | B1 | 5/2001 | Harrell et al. | |
| 6,438,495 | B1 * | 8/2002 | Chau et al. | 702/9 |
| 6,732,052 | B2 | 5/2004 | Macdonald et al. | |
| 7,000,710 | B1 | 2/2006 | Umback | |

(Continued)

FOREIGN PATENT DOCUMENTS

| | | |
|---|---|---|
| GB | 2335450 | 9/1999 |
| GB | 2367626 | 4/2002 |
| GB | 2384567 | 7/2003 |
| WO | 2007/020475 | 2/2007 |

*Primary Examiner* — Dwin M Craig
(74) *Attorney, Agent, or Firm* — Chadwick A. Sullivan; Brigitte Echols

(57) ABSTRACT

Steering behavior model can include build rate and/or turn rate equations to model bottom-hole assembly behavior. Build and/or turn rate equations can be calibrated by adjusting model parameters thereof to minimize any variance between actual response 118 and estimated response produced for an interval of the well. Estimated position and orientation 104 of a bottom-hole assembly along a subsequent interval can be generated by inputting subsequent tool settings into the calibrated steering behavior model. Estimated position and orientation 104 can be compared to a well plan 106 with a controller 108 which determines a corrective action 110. Corrective action 110 can be converted from a build and/or turn rate to a set of recommended tool settings 114 by using an inverse application 112 of the steering behavior model. As additional data 118 becomes available, steering behavior model can be further calibrated 102 through iteration.

14 Claims, 5 Drawing Sheets

(56) References Cited

U.S. PATENT DOCUMENTS

| | | | | |
|---|---|---|---|---|
| 7,290,443 | B2 | 11/2007 | Follini et al. | |
| 7,957,946 | B2 * | 6/2011 | Pirovolou | 703/10 |
| 2003/0016164 | A1 | 1/2003 | Finke et al. | |
| 2003/0034177 | A1 | 2/2003 | Chitwood et al. | |
| 2005/0209912 | A1 | 9/2005 | Veeningen et al. | |
| 2005/0268476 | A1 * | 12/2005 | Illfelder | 33/313 |
| 2006/0006000 | A1 * | 1/2006 | Weston et al. | 175/45 |
| 2006/0062081 | A1 | 3/2006 | Wu et al. | |
| 2007/0011719 | A1 | 1/2007 | Lin | |
| 2007/0057811 | A1 | 3/2007 | Mehta | |
| 2007/0187147 | A1 * | 8/2007 | Weston et al. | 175/45 |

* cited by examiner

METHOD OF AUTOMATICALLY CONTROLLING THE TRAJECTORY OF A DRILLED WELL

CROSS-REFERENCE TO RELATED APPLICATIONS

This application is a continuation of and claims priority to U.S. patent application Ser. No. 11/770,954, (now U.S. Pat. No. 7,597,946) entitled "METHOD OF AUTOMATICALLY CONTROLLING THE TRAJECTORY OF A DRILLED WELL," filed Jun. 29, 2007, the entire disclosure of which is hereby incorporated herein by reference.

BACKGROUND

The invention relates generally to methods of directionally drilling wells, particularly wells for the production of hydrocarbon products. More specifically, it relates to a method of automatic control of a steerable drilling tool to drill wells along a planned trajectory.

When drilling oil and gas wells for the exploration and production of hydrocarbons it is often desirable or necessary to deviate a well in a particular direction. Directional drilling is the intentional deviation of the wellbore from the path it would naturally take. In other words, directional drilling is the steering of the drill string so that it travels in a desired direction.

Directional drilling can be used for increasing the drainage of a particular well, for example, by forming deviated branch bores from a primary borehole. Directional drilling is also useful in the marine environment where a single offshore production platform can reach several hydrocarbon reservoirs by utilizing a plurality of deviated wells that can extend in any direction from the drilling platform.

Directional drilling also enables horizontal drilling through a reservoir. Horizontal drilling enables a longer section of the wellbore to traverse the payzone of a reservoir, thereby permitting increases in the production rate from the well.

A directional drilling system can also be used in vertical drilling operation. Often the drill bit will veer off of a planned drilling trajectory because of an unpredicted nature of the formations being penetrated or the varying forces that the drill bit experiences. When such a deviation occurs and is detected, a directional drilling system can be used to put the drill bit back on course with the well plan.

Known methods of directional drilling include the use of a rotary steerable system ("RSS"). In a RSS, the drill string is rotated from the surface, and downhole devices cause the drill bit to drill in the desired direction. RSS is preferable to utilizing a drilling motor system where the drill pipe is held rotationally stationary while mud is pumped through the motor to turn a drill bit located at the end of the mud motor. Rotating the entire drill string greatly reduces the occurrences of the drill string getting hung up or stuck during drilling from differential wall sticking and permits continuous flow of mud and cuttings to be moved in the annulus and constantly agitated by the movement of the drill string thereby preventing accumulations of cuttings in the well bore. Rotary steerable drilling systems for drilling deviated boreholes into the earth are generally classified as either "point-the-bit" systems or "push-the-bit" systems.

When drilling such a well, an operator typically referred to as a directional driller is responsible for controlling and steering the drill string, or more specifically, the bottom-hole assembly (BHA), to follow a specific well plan. Steering is achieved by adjusting certain drilling parameters, for example, the rotary speed of the drill string, the flow of drilling fluid (i.e., mud), and/or the weight on bit (WOB). The directional driller also typically operates the drilling tools at the end of the drill string so that the drilling direction is straight or follows a curve. These decisions to adjust the tool settings (e.g., the drilling parameters and/or the settings of the drilling tools) are made based on a data set that is measured at the surface and/or measured downhole and transmitted back by the drilling tools. An example of the data transmitted by the tools is the inclination and the azimuth of the well, as both are measured by appropriate sensors, referred to as D&I sensors in oilfield lexicon, in the bottom-hole assembly (BHA).

Typically, these measurements have been taken by static surveys made during the period of time the rotary table is quiescent as a new stand of pipe (approximately ninety feet in length) is attached at the rotary table to permit further drilling. These static survey points form the basis for determining where the BHA is located in relation to the drilling plan given to the directional driller by the geophysicist employed by the owner of the well.

The directional driller is a key link in the success of the drilling operation. The directional driller uses personal experience and judgment to make the decisions required to control the trajectory of the well and thus a level of proficiency and experience is needed to operate the directional drilling controls on the rig during drilling. As this decision making process is neither systematic nor predictable due to the lack of uniformity between wells, formations and BHAs used, directional drillers often differ in their decision making, yet these decisions generally all relate to maintaining the drilling assembly in accordance with a previously detailed well drilling plan. Each drilling program is unique and methods for the systematization of this process are currently being studied by the entire drilling industry. Directional drillers remain in high demand. Thus, there exists a need to automate the control of the directional drilling program to eliminate the need for the real-time supervision of the drilling by the directional driller on each directionally drilled well and to permit the directional driller to assume a more consultative position in the directional drilling process.

Irrespective of whether a directional driller is present on the drilling rig during operations, there exists a need for an improved automatic trajectory control method. Such a method, which can be either automatic or manual, can make the steering of the wells a more systematic, consistent, and predictable task than is provided for by currently existing techniques, while minimizing the reliance on scarce directional drillers to complete drilling programs.

SUMMARY OF THE INVENTION

In one aspect, a method of controlling the trajectory of a drill string includes providing a steering behavior model having a build rate equation and a turn rate equation, calibrating the steering behavior model by minimizing any variance between an actual build rate and an actual turn rate of a bottom-hole assembly generated by a first set of tool settings and a first estimated build rate and a first estimated turn rate generated by inputting the first set of tool settings into the steering behavior model, determining an estimated position and an estimated azimuth and inclination data set of the bottom-hole assembly by inputting a second set of tool settings into the calibrated steering behavior model, comparing the estimated position and the estimated azimuth and inclination data set to a well plan to determine any deviation of the bottom-hole assembly therefrom, and determining a corrective action to correct the any deviation.

In another aspect, a method of controlling the trajectory of a drill string includes providing a steering behavior model having a build rate equation and a turn rate equation, calibrating the steering behavior model at a first interval by minimizing any variance between an actual build rate and an actual turn rate of a bottom-hole assembly generated by a first set of tool settings and a first estimated build rate and a first estimated turn rate generated by inputting the first set of tool settings into the steering behavior model, determining a second estimated build rate and a second estimated turn rate at a second interval by inputting a subsequent second set of tool settings into the calibrated steering behavior model, comparing the second estimated build rate and the second estimated turn rate to a well plan to determine any deviation of the bottom-hole assembly therefrom, and determining with a controller a corrective action to correct the any deviation.

In another aspect, a method of controlling the trajectory of a drill string includes providing a steering behavior model having a build rate equation and a turn rate equation of a bottom-hole assembly, providing an actual azimuth and inclination data set for a first interval drilled with a first set of tool settings, determining an actual build rate and an actual turn rate for the first interval from the actual azimuth and inclination data set, calibrating the steering behavior model by minimizing any variance between the actual build rate and the actual turn rate and a first estimated build rate and a first estimated turn rate generated by inputting the first set of tool settings into the steering behavior model, determining a second estimated build rate and a second estimated turn rate with the calibrated steering behavior model for a subsequent second interval drilled with a subsequent second set of tool settings, integrating the second estimated build rate and the second estimated turn rate over the second interval to produce a second estimated azimuth and inclination data set for the second interval, integrating the second estimated azimuth and inclination data set over the second interval to produce an estimated position of the bottom-hole assembly, comparing with a controller at least one of the second estimated build rate and the second estimated turn rate, the second estimated azimuth and inclination data set, and the estimated position to a well plan to determine a corrective action, and determining with the controller a set of recommended tool settings from the corrective action and an inverse application of the calibrated steering behavior model.

Other aspects and advantages of the invention will be apparent from the following description and the appended claims.

DETAILED DESCRIPTION OF THE INVENTION

Figure 1A:
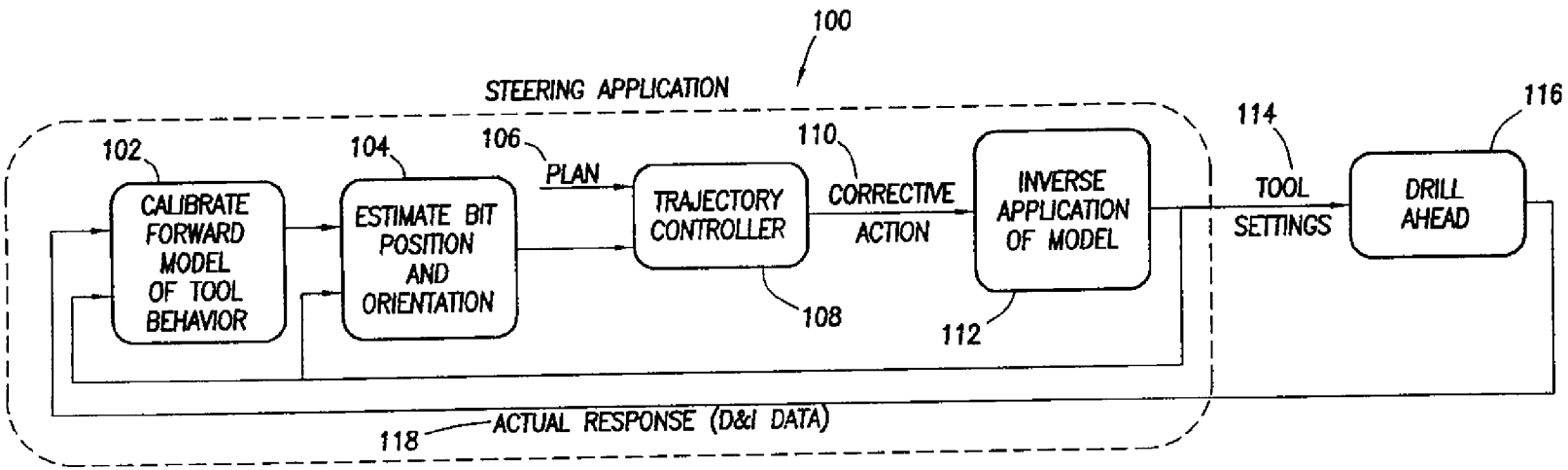
FIG. 1A is a flow diagram of a method of controlling the trajectory of a drilled well, according to one example.

The current invention provides a system and method of automatically controlling the trajectory of a drilled well. To automatically control the trajectory of a drilled well, a steering behavior model, which can be mathematical, software, or other digital form, is provided. The steering behavior model can use any methodology or tool to simulate the steering behavior of a drill string, or more specifically a bottom-hole assembly. The present invention relates to the calibration of a steering behavior model to minimize a variance between the steering behavior model of the well and the actual drilled well. FIG. 1A illustrates an example flow diagram. The steering application 100 can be used to create an automatic trajectory controller and/or an automatic steering application 100. A controller can be a computer. A controller can be any electrical or mechanical device, for example, for determining any corrections necessary to align an actual trajectory with a well plan or any other requirements.

Currently there are a number of different tools and methodologies that can be used to attempt the simulation or capture of the steering behavior of a drill string, or more specifically, the bottom-hole assembly thereof. For example, neural network or fuzzy systems can be used to capture the steering behavior, however as illustrated by the examples described below, the example steering behavior model disclosed herein offers increased simplicity and accuracy by using a simpler adaptive control. An adaptive control, for example, a linear regression algorithm, does not require a complicated training system including the complex weights and biases, multiple field tests (for example, to form different lithologic units), degrees of truth, and/or collections of rules defining degrees of movement of the tool based on the current position of the variance between a current and a preferred position of a wellbore.

One example of the steering behavior model utilizes build rate (BR), which is the rate the inclination changes versus depth, and/or turn rate (TR), which is the rate the azimuth changes versus depth, of the drill string (e.g., bottom-hole assembly) at any given point or interval of the well. In such an example, a mathematical steering behavior model can be developed that produces these two quantities, build rate (BR) and turn rate (TR), as a function of several other variables including, but not limited to, the actual position (which may only include depth, but may also include a three dimensional position within the Earth) and actual orientation, e.g., inclination and azimuth, of the bottom-hole assembly at a given location or time (a vector with this information is denoted as P); the properties of the formation that the BHA is drilling through (a vector with this information is denoted as F); the geometry of the bottom-hole assembly (a vector with this information is denoted as G); a set of model parameters that depend on the form of the functions f and g (see below) used to produce BR and TR (a vector with these model parameters is denoted as MP).

The model parameters (MP) are those variables of each mathematical model that can be adjusted during the calibration to minimize the variance between the estimated position and/or orientation (for example, estimated inclination and azimuth at a given point or interval of the well) and the actual position and/or orientation (for example, actual inclination and azimuth at that given point or interval of the well) of the drill string. The variables can also include the tool settings (cumulatively referred to as the vector TS). Tool settings (TS) can include any of the drilling tool settings (a vector with this information is denoted as DTS) and the drilling parameters (a vector with this information is denoted as DP) and thus tool settings (TS)=DP+DTS. Drilling tool settings (DTS) can include, but are not limited to, toolface angle, steering ratio, drilling cycle, etc. Drilling parameters (DP) can include, but are not limited to, weight on bit, the mud flow rate, the rotation speed of the drill string, slide versus rotation of the drill string, the rotation speed of the drill bit, etc.

Mathematically, one can write two equations for the build rate (BR) and the turn rate (TR) as: BR=f (DP, DTS, P, F, G, MP) and TR=g (DP, DTS, P, F, G, MP), respectively. Mathematical equations f and/or g are preferably standard algebraic equations, for example a polynomial, but can be any mathematical function suitable for capturing the steering behavior of a drill string and/or bottom-hole assembly.

Some of the variables or portions thereof, which are used as input to the build rate equations and/or turn rate equations of the steering behavior model, can be incomplete or unavailable. In these cases, simplified versions of the equations f and g can be used to capture the steering behavior of the bottom-hole assembly, as is known in the art. An example of a build rate equation is BR=f (steering rate×ability of the tool×cosine (toolface angle+toolface offset)+sinking bias). The sinking or "drop" bias can be a model parameter adjusted to produce a best fit of the equation and the toolface angle can be a drilling tool setting. An example of a turn rate equation is TR=g (steering rate×ability of the tool×sine (toolface angle+toolface offset)+walk bias). The walk bias can be a model parameter adjusted to produce a best fit of the equation and the toolface angle can be a drilling tool setting. The azimuth can be understood graphically as the area under the turn rate vs. depth plot. The inclination can be understood graphically as the area under the build rate vs. depth plot. As the length of hole increases, e.g., hole depth, the increments in that area can change.

To form the steering behavior model described above, a mathematical equation simulating the behavior of the bottom-hole assembly can be selected. This invention allows an understanding of the behavior of a drill string, or more specifically, the bottom-hole assembly, and does not just measure the accuracy of a model as in the prior art, for example. The steering behavior model can be created using a linear regression algorithm for the build rate (BR) and/or for the turn rate (TR). A variable of the linear regression algorithm can be the tool settings (TS). Linear regression algorithms are well known in the art. In FIG. 2, a steering behavior model can be calibrated 102 by adjusting the model parameters (MP) to dynamically minimize the variance in the estimated position and orientation and the actual position and orientation over the observation sets, for example, by the least squares method. In one example, the model parameters can be adjusted to dynamically minimize the variance in the estimated build rate and turn rate and the actual build rate and turn rate over observation sets where the actual build rate and turn rate data is available.

As the well is drilled to greater depths, typically an increased amount of data becomes available. This data includes, or can be used to calculate, the actual position and orientation 118 of the bottom-hole assembly at different times or depths. One non-limited example of such data is azimuth and inclination data from a D&I sensor. The actual build rate and turn rate can be calculated as the inclination at multiple depths and azimuth at multiple depths is returned by the D&I sensors.

As the last transmitted tool settings (TS) 114, which can include the drilling parameters (DP) and drilling tool settings (DTS), are typically known, the tool settings 114, the model parameters (MP), and any other known variables (e.g., F, G) can be used as input into the steering behavior model to produce an estimate of the build rate and turn rate of the bottom-hole assembly achieved by those actual tool settings (TS) (e.g., as the drill string advances). As the sensors, for example, a D&I sensor, are typically located at a distance from the bit itself and/or the sensor data can lag behind relative to the tool settings (TS), the build and turn rate equations of the steering behavior model can provide an estimate of the position and orientation of the D&I sensor and/or bit.

Figure 2A:
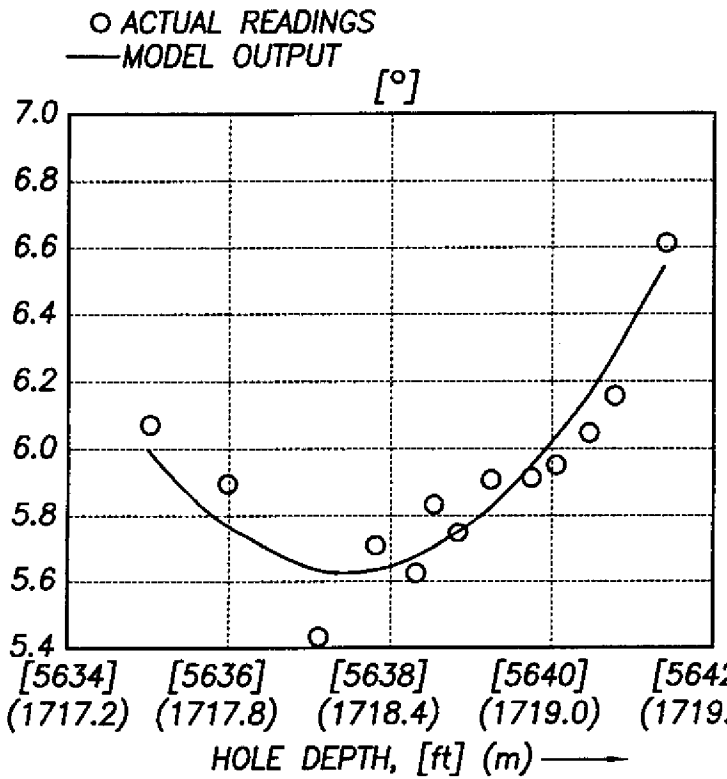
FIG. 2A is a graph of actual inclination and estimated inclination along an interval of drilled well, according to one example.
Figure 2B:
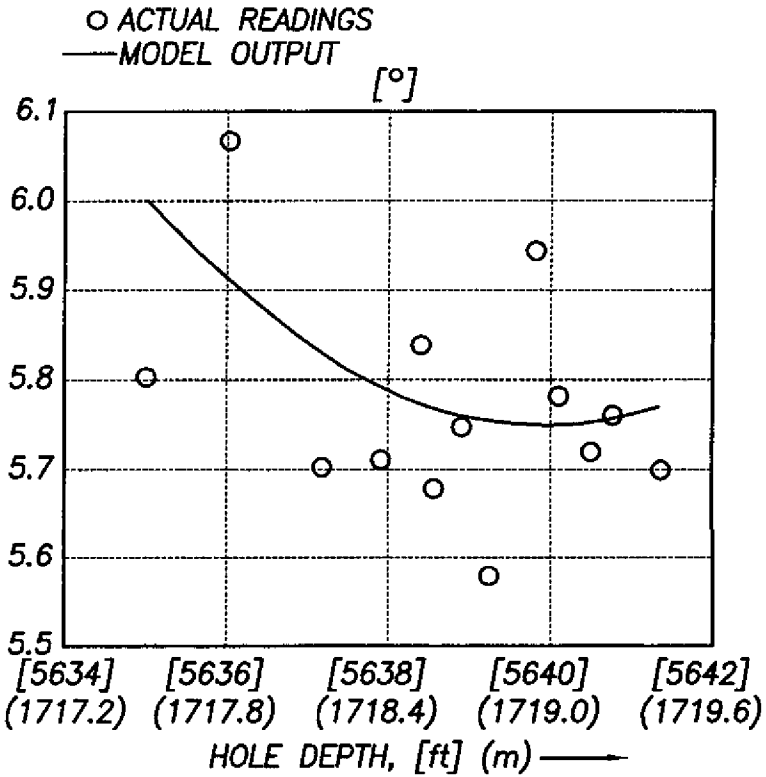
FIG. 2B is a graph of actual azimuth and estimated azimuth along an interval of drilled well, according to one example.

Build and turn rate equations of the steering behavior model can serve as the integrand, and thus be mathematically integrated over a desired interval, for example, a range of depths, to produce the estimated position and orientation, for example, the degrees of azimuth and inclination change over that range of depth. The lower and upper limits of integration are likewise adjustable to any desired interval, for example, between two depths. The integrated forms of equations f (build rate) and g (turn rate) can be used to estimate inclination and azimuth at an interval, respectively, as shown in FIGS. 2A-2B, which can be compared to the actual inclination and azimuth data 118 received to calibrate 102 the model. The solution set from this repeated calculation more accurately describes the behavior of the BHA as it drills through the given formation.

One aspect of the present invention is to dynamically calibrate the steering behavior model using data 118 that is acquired during the drilling operation. After providing a steering behavior model, the model can be iteratively calibrated 102 to capture the steering behavior of the drill string (i.e., bottom-hole assembly). The estimated response 104, for example, can be produced in terms of build rate and turning rate and/or azimuth and inclination (e.g., the integral of the build rate (f) and turn rate (g) functions), which can be further integrated to provide the position. If this estimated response 104 for a set of tool settings has the minimal desired variance relative to the actual response (as it is measured by sensors) 118 for the interval corresponding to those tool settings, the steering behavior model can be deemed to produce accurate predictions. If the estimated 104 and actual 118 position and orientation have a greater variance than desired by the user and/or controller, then there is a need to update at least one of the model parameters (MP). This is the dynamic calibration concept.

Calibration 102 compares known value(s) to a value(s) estimated from the steering behavior model and minimizes any difference therebetween. The minimization can occur between two points, or any plurality of points to produce a best fit model. When the steering behavior model has been calibrated so as to describe the behavior of the bottom-hole assembly to a level satisfactory to the user (or controller), the model can then be used to create projection(s) of the build rate and turn rate of the drill string "ahead" of actual data, for example, ahead of actual azimuth and inclination data from direction and inclination (D&I) sensors which typically lag.

Similarly, the steering behavior model can produce estimates of the position and orientation (e.g., azimuth and inclination at a depth(s)) of the BHA before the data set corresponding to the actual position and orientation is made available and/or before the steering behavior model is calibrated 102 with the most recent data set 118. Estimates or projections 104 of the behavior, position, and/or orientation (for example, the azimuth and inclination) of the bottom-hole assembly, can be at the location of the sensors, or even estimates further ahead at or in front of the drill bit as the distance from the sensors to the drill bit is typically known.

As the current tool settings (TS), including both the drilling tool settings (DTS) and the drilling parameters (DP), are typically known, for example in real-time, the build rate and turn rate (or the position and/or orientation of the bottom-hole assembly determined by integration) can be estimated by extrapolating the steering behavior model to a point in the well (e.g., time and/or depth) utilizing those tool settings and the model parameters determined in the previous calibration 102, as is described in detail below. As the drill string continues to drill, eventually a data set, which preferably includes the inclination and azimuth measurements of the bottom-hole assembly from a D&I sensor package, will be received at or after the projection occurs. The data set can include the actual inclination and azimuth measurements corresponding to the estimated inclination and azimuth formed by the model for a corresponding section of the well.

The actual data points can then be compared to the estimated data points 104 to re-calibrate the model 102. Calibration can include the least squares method, least mean squares method, and/or curve fitting; however, any mathematical optimization technique for fitting a mathematical function to a data set can be used. The simplicity of using a conventional linear regression algorithm to estimate the functions f and/or g allows the calibration or re-calibration of the model by re-estimating the model parameters (MP), with additional data sets retrieved during the drilling process. These data sets can consist of a single variable typically referred to as the "error" relative to the response variable (e.g., the tool settings) estimated in a linear regression algorithm. Functions f and g can have the same set of model parameters (MP) or different set(s), as required to produce the desired fit of the functions to the behavior of the bottom-hole assembly. The model parameters (MP) created or adjusted during the calibration step 102 can be utilized in functions f and/or g in both producing the estimated position and orientation 104 and, as discussed below, in determining the set of recommended tool settings 114 with the inverse application 112. A linear regression algorithm does not limit the resulting function to be a straight line; the term linear merely refers to the response of the explanatory variables being a linear function of the estimated parameter of the equation.

A steering behavior model, more particularly an inverse application 112 thereof, can also be used to produce a set of recommended tool settings 114 (e.g., commands) for the surface equipment and/or the drilling tools to achieve a corrective action. The above is the broad picture of automated drilling operations. A steering application 100 to automate the steering of the bottom-hole assembly can utilize such a steering behavior model to create a future projection of a drilled well, for example, a future (e.g., estimated) orientation and position 104. Any step of the method can be accomplished with a controller.

Graphs of actual and estimated inclination versus hole depth can be seen in FIG. 2A and of actual and estimated azimuth versus hole depth in FIG. 2B. FIGS. 2A and 2B further illustrate the "best fit" nature of one example of the steering behavior model. As the actual inclination and azimuth measurements 118 are typically part of the sensor package, they can be used to calibrate 102 the steering behavior model. More specifically, as the tool settings 114 (TS), formation (F), geometry of the bottom-hole assembly (G), and/or actual response 118 (e.g., position and orientation (P)) corresponding to the time period the estimate 104 was formed become available, the model parameters (MP) can be calibrated 102 to fit the functions f and/or g to that data, e.g., the model parameters (MP) can be solved for in the calibration step 102 for a section of well. For example, the functions can be integrated to produce the estimated orientation and position, as discussed further in reference to FIG. 1B, or as an actual reading(s) of inclination is known from the D&I data 118 for a previous point(s) (e.g., point 122 in FIG. 3), the estimated inclination can be calculated at a subsequent point(s) (e.g., point 124 in FIG. 3) as the estimated inclination change between the previous point (e.g., point 122 in FIG. 3) and the subsequent point (e.g., point 124 in FIG. 3) can be produced from the integrated build rate equation with a set of known tool settings (TS). This can be similarly accomplished for an azimuth reading(s) and the turn rate equation.

After the steering behavior model is calibrated or trained to a desired level of accuracy, the model can then be used to form a second estimate or prediction. The second estimate extrapolates "ahead" of the downhole sensors that measure the inclination and azimuth of the well (D&I sensor package). The steering behavior model thus creates estimates, or projections, of the quantities of interest, for example, before they are measured in reality and/or before they are utilized to calibrate 102 the steering behavior model.

More specifically, the values of the drilling parameters (DP) and the tool settings (TS) that have been used for drilling the well thus far are typically known (i.e., up to the point to which an estimate is being determined). These tool settings 114 (DP and DTS) can be used as input into the calibrated steering behavior model to estimate what is happening at the bottom-hole assembly without waiting for positive confirmation by the sensors (e.g., the position and orientation). Due to the lengthy transmittal times, data can lag such that the position and orientation data is received at a time (e.g., present time) that is as much as 30-40 meters behind the real time location of the bit. Such a steering behavior model can avoid the problems introduced by the delayed measurements.

Additionally, a projection 104 (e.g., an estimate of the bottom-hole assembly position and orientation) can be compared to a preexisting well plan 106, and, if necessary, a corrective action (e.g., desired response) 110 can be determined and typically implemented. The corrective action 110 can be determined by a controller 108, or more specifically, a trajectory controller. The corrective action 110 can be such that the actual trajectory of the drilled well follows the planned trajectory from the well plan if the objective of drilling is hitting a target of interest, and as such the well can be re-aligned to the well plan 106.

A well plan 106, which can include, but is not limited to, target areas, areas to avoid, geometric shapes for the drilled well, or any other aspects of trajectory, is provided, as is known in the art. The estimated position and orientation 104 produced by the steering behavior model can then be compared to the well plan 106, for example, comparing the estimated inclination and azimuth 104 at a depth or depth interval to the well plan's inclination and azimuth at that depth or depth interval. This comparative step is preferably accomplished by a controller 108 or other automating processor. If the estimated position and orientation 104 of the well deviates from the well plan 106 at a level that is deemed unacceptable, for example a user set level of maximum deviation, the controller 108 can determine a corrective action 110.

Figure 3:
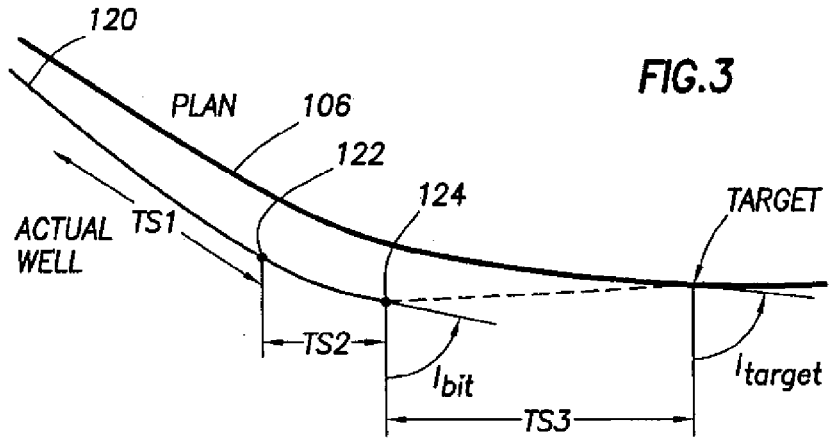
FIG. 3 is schematic view of the inclination of a well plan compared to the inclination of a drilled well, according to one example.

Controller 108 determines any corrections necessary to align the actual trajectory 118 with the plan 106 in FIG. 3, or to meet any other requirements. For example, if the well is already in a pay zone (i.e., formation where there is oil or gas), the objective can be to stay in the pay zone instead of strict adherence to a pre-determined geometric plan. The corrective actions 110 coming out of the controller can thus be dictated by a number of different requirements, and not simply by the need to follow the well plan 106. In the example illustrated in FIG. 1A, the controller and not the human directional driller comes up with this decision.

If the current tool settings 114 produce an estimated bit position and orientation 104 that are within the acceptable range of the well plan 106, the desired response 110 (e.g., corrective action) can be to continue drilling with the current set of tool settings 114.

However, if the controller 108 determines a corrective action 110 is appropriate, controller 108 can calculate a corrective action 110 (or actions) necessary to align the current trajectory 118 of the drill string with the well plan 106 trajectory. In one example using a build rate equation and turn rate equation as the steering behavior model, the corrective action (e.g., desired response of the bottom-hole assembly) 110 can be outputted as a desired build rate (BR) and turn rate (TR). More specifically, the controller 108 compares the actual trajectory to the desired one (e.g., well plan 106), and can derive a path to bring the actual drilled well back onto the plan 106. This corrective action 110 can be subject to additional constraints, such as a degree of total change or smoothness of the trajectory or that the corrective action 110 does not allow the actual well to penetrate a user-defined target or boundary, etc.

If a corrective action 110 desired from the drilling tools is known, the commands (e.g., tool settings 114) to be sent to the drilling tools 116 to achieve this desired response can be determined. Difficulties in determining the tool settings 114 can abound as the drilling process is subject to a number of uncertainties (non-uniform formations, external disturbances that affect the steering behavior of the drilling tools, signal noise, etc.). The manifestation of these uncertainties is that the drill string can be ordered to drill in a certain direction, but the actual result is significantly different. Thus the method can provide the appropriate set of recommended tool settings 114 that will generate the response desired. This can be achieved using a different aspect of the present disclosure, or more specifically, an inverse application of the steering behavior model 112.

Once the appropriate tool settings 114 for the drilling tools have been obtained, the tool can drill forward, and new data 118 can become available. The new data (e.g., actual response) 118 can be utilized then, or in the future, to repeat the process previously described to calibrate 102 the steering behavior model as is discussed in further detail below. Any or all of the steps of this invention can be achieved with a controller.

As the desired corrective action 110 can be determined in terms of a recommended build rate (BR) and turn rate (TR) over an interval of the well, these rates can be converted into a set of recommended tool settings. In one example, the determining of the set of recommended tool settings (e.g., the new tool settings) is accomplished by using the inverse application 112 of the steering behavior model calibrated earlier. This forward application 104 of the steering behavior model resolves, given a subsequent set of tool settings of the drilling parameters (DP) (weight on bit, mud flow, etc.) and/or the drilling tool settings (DTS) (steering ratio, toolface angle, etc.), the estimated build rate and turn rate, which can provide the estimated position and orientation, of the down hole assembly achieved with those subsequent set of tool settings. Thus a projection of the drilled well is created. The inverse application 112 can be used to calculate, beginning at a previous point of the well, the necessary tool settings (TS), or changes thereof, needed in order to obtain the desired position and orientation of the bottom-hole assembly (e.g., the desired response 110) at a future point. As such, an undesired variance between the estimated position and orientation 104 and the well plan 106 can be corrected with the set or recommended tool settings 114.

After the inverse application 112 provides the recommended tool settings 114 to correct the variance as desired, the tool settings 114 can then be outputted. The output can be a visual or other display or can be an automatic transmittal to a control means of the drill string, as is known in the art. Drilling can pause between the receipt of new data and the output of tool settings or the drilling can be continuous during this iterative process. After the tool settings are changed to the recommended set of tool settings 114, drilling typically continues until the new data set, for example, actual position and orientation data 118, is received. The iterative process of calibrating the model 102, producing an estimated position and orientation 104, comparing the estimate to a well plan 106 with a controller 108, determining a corrective action 110 (if needed), and using an inverse application 112 of the steering behavior model previously calibrated 102 to produce a set of recommended tool settings 114 can be repeated all over when new data becomes available or as otherwise desired to further calibrate the model. Such a steering application 100 can be done entirely or partially with a controller.

Complications can arise when the drilling operations are subject to external disturbances, which are typically referred to as steering events. A steering event is anything that causes the bottom-hole assembly to behave in a manner different than the prior behavior. A steering event can be caused by an external factor, for example, a formation change, or by the user or other controller of the tool settings. The steering behavior model, e.g., functions f and g, are calibrated to closely approximate any changes, based on the measured data, in order to adjust the appropriate model parameters (MP). For example, when using the functions f and g over an interval covering 100 meters, a poor fit may be obtained, for example, because a steering event has occurred and it is not possible to fit a single function over the entire interval. Instead, the steering behavior model can include additional functions f and g to sub-intervals to more closely approximate the behavior of the bottom-hole assembly. Typically this is accomplished by identifying the most likely depth where the steering event occurred, and fitting different versions of the functions f and/or g on the sub-intervals before and after the event. This can also be accomplished with a controller.

Searching for the steering event, as well as selecting the functions f and g before and/or after the event, can be part of the iterative calibration process that minimizes the fitting error, in addition to adjusting the model parameter(s). The steering behavior model can input different forms of the equations f and/or g and different variations of the model parameter(s) before and/or after each candidate event until the steering behavior model for that steering event fits satisfactorily to the observed (measured) data 118. Once this is done successfully, the functions f and/or g that are selected can be used for creating the projections 104, and/or tool settings 114, as is described above.

FIG. 3 is a schematic illustration of one example of a well plan 106. FIG. 3 shows that at the target depth, the inclination (I bit) does not match the inclination of the well plan at the target (I target). The well 120 has deviated from the well plan 106, and thus a corrective action (shown with dotted line) is determined by the controller 108.

The use of one example of the method will now be described in reference to FIG. 3. FIG. 3 graphically illustrates an inclination of a well versus depth, (e.g., the slope of the line at each point is the build rate), although a data table can be used. The following methodologies can similarly be utilized for azimuth measurements using the turn rate equation, etc.

A build rate and/or turn rate equation, which can include a best guess for the model parameters or include model parameters that were calculated in a previous calibration, is supplied. In the following example, assume the actual azimuth and inclination data set 118 from the D&I sensors has been received up to the point marked as 122 on FIG. 3. Point 122 and above can be referred to as a first depth interval. The tool settings 114 (TS1) (e.g., tool face angle, etc.) used to generate the wellbore 120 up to point 122 are known. Best estimates can also be used in case some measurements are not available.

As the tool settings (TS1) are known and a data set of the inclination, azimuth, and position (which can be converted into a build rate and turn rate) are known, the build rate and turn rate equations can be calibrated by inputting the tool settings (TS1) into the build rate and/or turn rate equations and adjusting the model parameters to produce a desired fit of the build rate and/or turn rate equations for the actual inclination and azimuth data set.

One can also calibrate the build rate and/or turn rate equations by performing a mathematical integration on the equations, as is known by one of ordinary skill in the art. In reference to FIG. 3, for example, assuming that the drill bit (or the sensor of the bottom-hole assembly) is at point 124 and the azimuth and inclination data set 118 up to point 122 as well as the tool settings (TS1) used to drill the corresponding section of wellbore 120 up to point 122 are known, integrating the build rate equation over the first depth interval (i.e., point 122 and above) will produce the estimated inclination over the first depth interval. The estimated inclination data set produced by the integration can be compared to the actual inclination data set 118 provided by the D&I sensors, for example, as shown in FIG. 2, and the model parameter(s) (MP) adjusted to minimize the variation therebetween up to point 122 as desired. This calculation can be repeated as further azimuth and inclination data becomes available. The steering behavior model, and thus calibration thereof, can include a single build rate equation and/or a single turn rate equation for an entire drilled wellbore or, as discussed above in reference to steering events, different versions of build rate equations and/or turn rate equations to fit sub-intervals of the drilled wellbore to best fit the D&I data 118.

A calibrated 102 build rate equation and/or turn rate equation can be used to create an estimate or projection 104 of the position and orientation (e.g., azimuth and inclination) of the bottom-hole assembly. For example, if the drill bit (or the sensor of the bottom-hole assembly) is at point 124, the tool settings (TS2) utilized between points 122 and 124 would be known, although the D&I data between those points may not be known due to lag, for example. These tool settings (TS2) can be inputted into the calibrated form of the build rate equation and/or turn rate equation to produce an estimated build rate and estimated turn rate for the second depth interval (between points 122 and 124). Note the actual azimuth and inclination at point 122 can be known. As noted above, the calibrated build rate equation and/or turn rate equation can be integrated over the second depth interval (i.e., between points 122 and 124) to produce an estimated azimuth and inclination data set for the second depth interval.

A well plan 106 in FIGS. 1A and 3, as is known in the art, can be in the form of the turn rate and build rate (e.g., over the second depth interval) or in the form of azimuth vs. depth (e.g., integral of turn rate) and/or inclination vs. depth (e.g., integral of build rate). If the well plan 106 is in the latter form, the integrated forms of the turn rate and build rate equations can be utilized to produce the estimated azimuth and inclination data set for the second depth interval. The well plan 106 can then be compared, for example by controller 108, to the estimated position and orientation formed from the calibrated steering behavior model.

The controller 108 can determine a corrective action 110 to correct any undesired deviation from the well plan 106. The controller 108 can form a corrective action 110 in the form of a targeted location or in terms of desired build rate and turn rate to correct the undesired deviation, but is not so limited. More specifically, the controller 108 can compare the actual trajectory to the desired one (e.g., well plan 106), and can derive a smooth path to bring the actual drilled well back onto the plan 106. This corrective action 110 can be subject to additional constraints, such as a degree of total change or smoothness of the trajectory or that the corrective action 110 does not allow the actual well to penetrate a user-defined target or boundary, etc. Once the corrective action 110 is formed, for example, in terms of build rate and a turn rate over an interval of the well, for example an additional length of pipe fed into the wellbore, it can be converted into appropriate tool settings (TS) 114. The conversion of the corrective action 110 can be achieved with a controller. A corrective action 110 can be converted to tool settings 114 (e.g., TS3 in FIG. 3) by using an inverse application of the calibrated steering behavior model 102. More specifically, as the corrective action 110 (e.g., build rate and turn rate over a defined interval of the well between point 124 and a point ahead of point 124), an actual position and orientation of the bottom-hole assembly, (e.g., point 122 in FIG. 3), and the model parameters (MP) are known, the build rate equation and turn rate equation can be solved to produce the tool settings (TS3) over the defined interval to achieve the corrective action 110.

The model can be further calibrated, e.g., the iterative search process of forming the model parameters and/or build rate and turn rate equations, with the receipt of the azimuth and inclination data set corresponding to the second depth interval (i.e., between points 122 and 124). This second actual azimuth and inclination data set can be compared to the estimated azimuth and inclination data set generated from inputting the second set of tool settings into the calibrated steering behavior model, and the variance therebetween minimized to further calibrate the model. This calibration can include adjusting the model parameters and/or adding new forms of the build rate or turn rate equations. Such a further calibrated steering behavior model can then be utilized to form projections of the bottom-hole assembly at a point subsequent to point 124 to which the tools settings are known. Similarly, calibration can be cumulative and include comparing the entire first and second actual azimuth and inclination data set (i.e., point 124 and above) to an entire estimated azimuth and inclination data set generated by inputting the first (TS1) and second (TS2) set of tool settings into the calibrated steering behavior model, and the variance therebetween minimized to further calibrate the model. The interval of the well calibrated can depend on the fit of the model, for example, multiple equations and/or differing sets of model parameters to produce a best fit for a drilled wellbore.

Figure 1B:
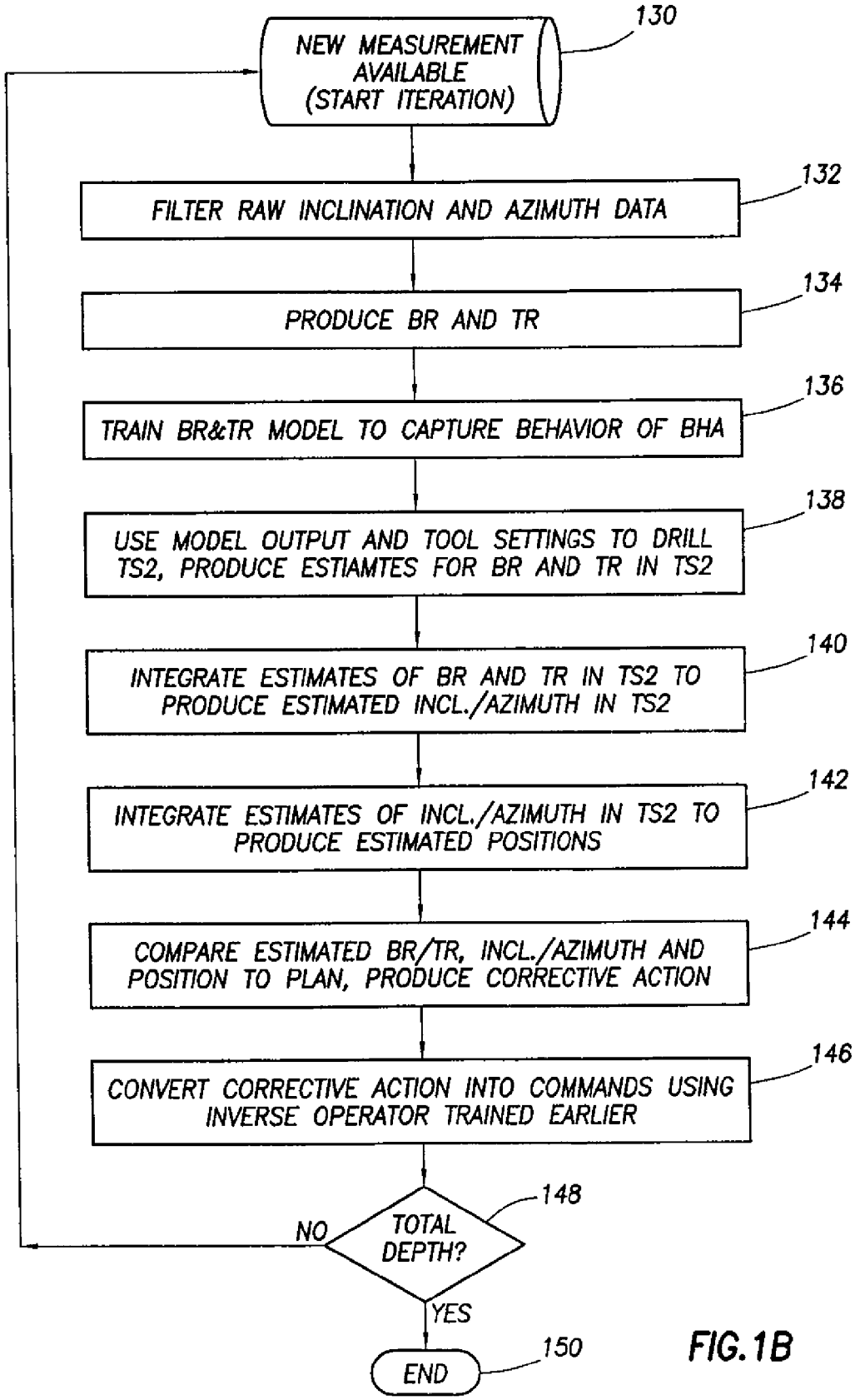
FIG. 1B is a flow diagram of a method of controlling the trajectory of a drilled well, according to one example.

FIG. 1B depicts a flow diagram of another example method of controlling the trajectory of a drill string. In this example, the steering behavior model can include two mathematical functions f and g as noted above, for build rate and turn rate respectively. Equations f and/or g can be estimated using linear regression algorithms. The steering behavior model itself can be a digital model, for example, software, or more specifically a spreadsheet. In this example, the steering behavior model is iteratively trained to model the behavior of the BHA. The method can use the other data in between static D&I data as well as reduce drilling complexity into a minimal amount of model parameters for example, dog leg capability, tool face capability, drop tendency, and walk tendency. The model can begin with a best estimate for the model parameters or solve for them initially.

In FIG. 1B, starting with element 130, a new measurement(s) is made available so iteration can begin. In this example, the measurement(s) can include a D&I data set, which can include the actual azimuth, inclination, and position, e.g., the location of the bottom-hole assembly. Optionally, the raw data can be filtered 132, as is known to one of ordinary skill in the art, to produce an actual inclination and azimuth data set for a first point or interval of the drilled well. As the build rate (BR) is the inclination change versus depth and the turn rate (TR) is the azimuth change versus depth, the actual inclination and azimuth data set 132 can be utilized to produce a build rate and turn rate 134. If the actual inclination and azimuth data set 132 is for a single point, then an inclination and azimuth measurement at a previous point can be used to calculate the actual build rate and turn rate between those two points. If the actual inclination and azimuth data set 132 is for an interval of the well, the inclination and azimuth data 132 can be used to calculate the actual build rate and turn rate 134 over that interval.

Because the actual build rate and turn rate corresponds to a section of well which has already been drilled, the tool settings, which can be referred to as $TS_n$, used to drill are typically known. The steering behavior model in FIG. 1B can be trained or calibrated 136 by inputting the tool settings (e.g., those used to drill the section of well corresponding to the actual build rate and turn rate) into the build rate and turn rate equations to produce an estimated build rate and an estimated turn rate for that section of well. The model parameters (MP) can then be adjusted to minimize any undesired variance between the actual build rate and turn rate and the estimated build rate and turn rate. This calibration can be a typical "best fit" operation.

The calibrated 136 steering behavior model can then be used to produce projections of the bottom-hole assembly. More specifically, as the D&I data can lag or be intentionally delayed, a second set of tool settings ($TS_{n+1}$) utilized from the last point of calibration to a subsequent point is typically known. As shown in element 138, the second set of tool settings can be inputted into the calibrated 136 build rate and turn rate equations to produce a second estimated build rate and turn rate corresponding to the section of well drilled with the second set of tool settings. As the build rate (BR) is the inclination change over an interval, the integral of the build rate equation f produces the estimated inclination for that interval. A depth interval can refer to a length of pipe inserted into the earth, and is not limited to vertical displacement. Similarly, the turn rate (TR) is the rate the azimuth changes over an interval and thus integrating the turn rate equation g over that interval produces the estimated azimuth for that interval. The first integration 140 of the build rate and turn rate equations thus produces an estimated azimuth and inclination data set for the interval of integration. Alternatively or additionally, a second integration 142 of the build rate and turn rate equations can produce the estimated position of the bottom-hole assembly. For example, the estimated inclination and azimuth produced in step 140 can be integrated over an interval to produce the estimated position of the bottom-hole assembly corresponding to that interval.

The estimated azimuth and inclination, as well as estimated position, can thus be calculated by integrating the calibrated 136 build rate and turn rate equations. The estimated build rate, turn rate, azimuth, inclination, position, or any combination thereof determined from the calibrated build rate and turn rate equations can be compared to a well plan 144 to produce a corrective action. In one example, a well plan is in terms of desired or target inclination, azimuth, and position. If the estimated azimuth, inclination, and position of the well over the section of the well (e.g., the projection) has deviated from the well plan, for example, from a set level of allowable deviation, a corrective action to return the well on plan can be determined, as in element 144. In one example, the corrective action 144 is outputted in terms of build rate and turn rate to align the desired well plan and the estimated drilled well, for example, at some future point.

If the corrective action is outputted as a build rate and turn rate, the rates can be converted into recommended tool settings using an inverse application 146 of the calibrated steering behavior model. In step 138 discussed above, known tool settings are inputted into the calibrated steering behavior model to generate an estimated build and turn rate. However in this step 146, the desired build rate and turn rate desired to align the well and the well plan are inputted into the calibrated steering behavior model and the tool settings to achieve that build rate and turn rate are returned. These recommended tool settings can then be utilized to drill the well. If further drilling is required to reach the target 148, the model can be iteratively calibrated. When the D&I data corresponding to the section of well drilled with the set of recommended tool settings is available, the data can be filtered 132, the actual build rate and turn rate for the interval corresponding to the set of recommended tool settings can be determined 134, and the model further calibrated 136 by inputting the recommended tool settings (e.g., those used to drill the section of well corresponding to the actual build rate and turn rate) into the calibrated build rate and turn rate equations to produce an estimated build rate and an estimated turn rate for that section of well. The model parameters (MP) can then be adjusted to minimize any undesired variance between the actual build rate and turn rate and the estimated build rate and turn rate. This further calibration can be a typical "best fit" operation. The calibration can be for the entire well up the last data point or it can be calibrated for discrete intervals of the well, as is known in the art.

Figure 4:
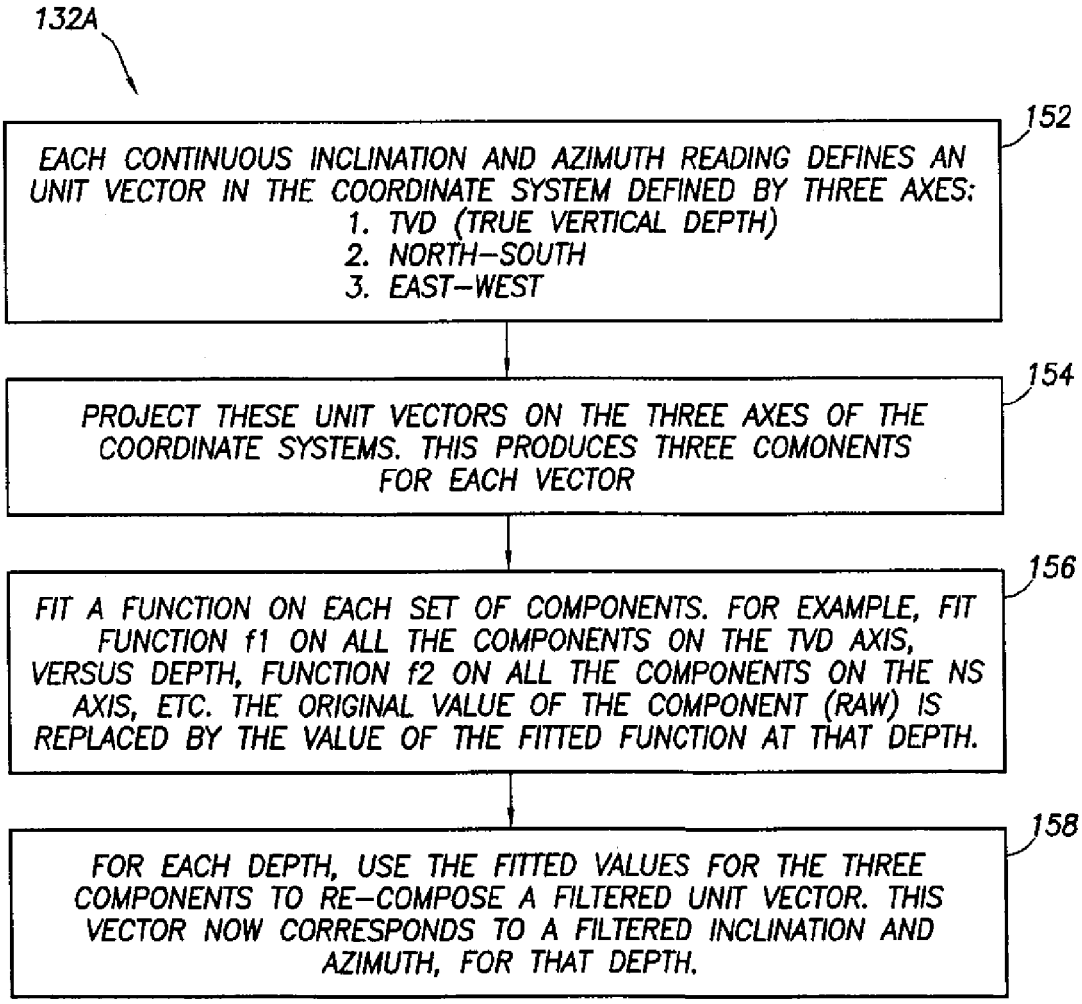
FIG. 4 is a flow diagram of a method of filtering raw data, according to one example.

FIG. 4 is a flow diagram of a method 132A of filtering raw data, according to one example. For example, the steps 132A in FIG. 4 can be included as step 132 in FIG. 1B. Filtering data can include providing a coordinate system having three axes, which can be true vertical depth (TVD), North-South, and East-West axes 152. An azimuth and inclination data set can then be divided into a unit vector having three components, which can be true vertical depth (TVD), North-South, and East-West components, and projecting these unit vectors onto the coordinate system 154. Additional azimuth and inclination data readings can be projected onto the three axes of the coordinate system. A mathematical function can then be fit (e.g., a best fit) to the components 156. The step of fitting 156 can be fitting a mathematical function to each individual component set, for example, TVD components versus depth, North-South components versus depth, and East-West components versus depth. The original components of the azimuth and inclination data set can be replaces by a value generated by the fitted function(s) at that depth, where depth can be total length of hole formed, which can be different from the TVD. The fitted functions for the three components generated at a depth can then be combined to form a filtered (e.g., fitted) azimuth and inclination data readings, at that depth 158.

Figure 5:
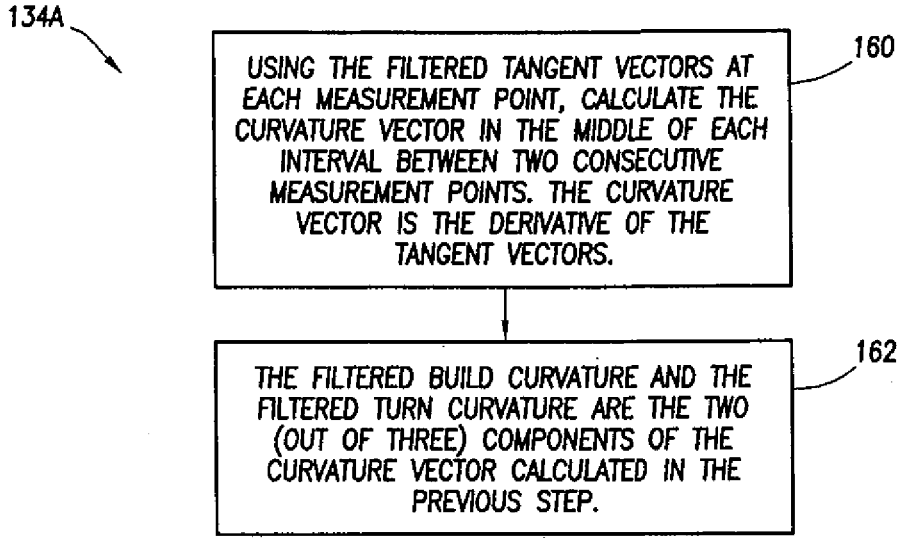
FIG. 5 is a flow diagram of a method of producing build and turn rate from filtered raw data, according to one example.

FIG. 5 is a flow diagram of a method 134A of producing build and turn rate from filtered raw data, according to one example. For example, the steps 134A in FIG. 5 can be included as step 134 in FIG. 1B. To produce actual build and actual turn rate values, filtered unit (e.g., tangent) vectors, for example, unit vector having true vertical depth (TVD), North-South, and East-West components, can be provided (e.g., provided at multiple depths). Using the filtered unit (e.g., tangent) vectors at each measurement point (which can be produced in previous step 132 or 132A), a curvature vector in the middle of each interval between two consecutive measurement points can be calculated 160. Curvature vector is the derivative of the unit (e.g., tangent) vectors. The filtered build curvature and the filtered turn curvature 162 (the quantities we are interested in) are the two (out of three) components of the curvature vector calculated in the previous step 160.

Figure 6:
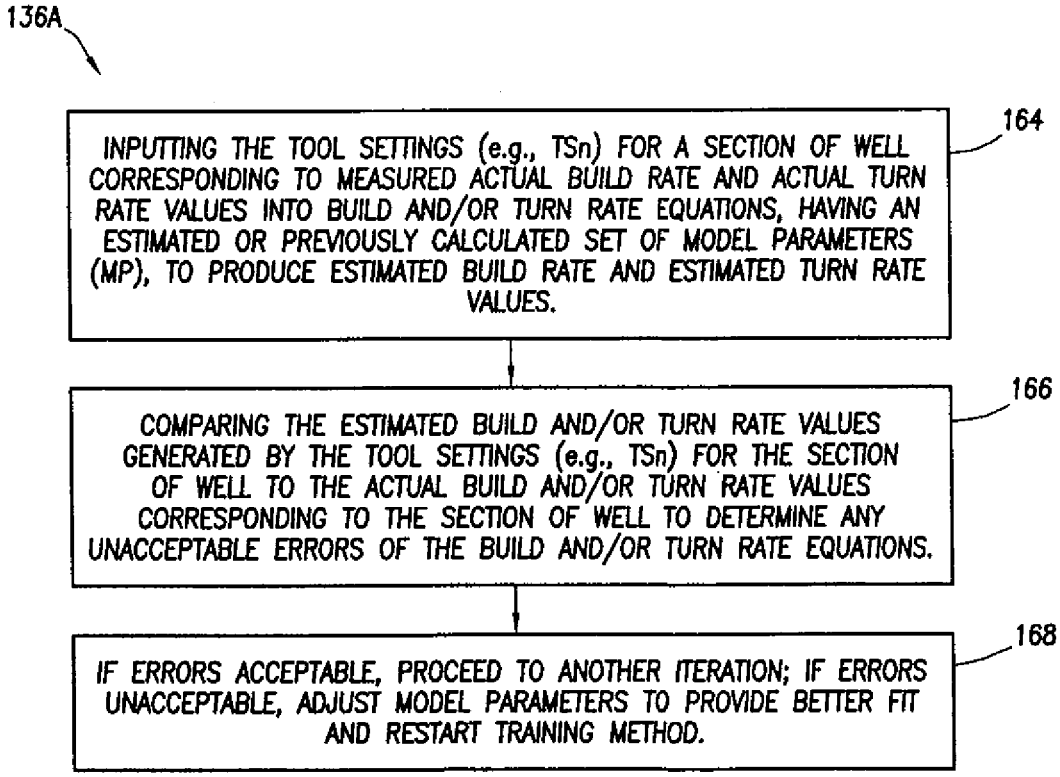
FIG. 6 is a flow diagram of a method of training a steering model, according to one example.

FIG. 6 is a flow diagram of a method 136A of training a steering model, according to one example. For example, the step 136A in FIG. 6 can be included as step method in FIG. 1B. Training the steering model can include producing an optimal set of model parameters (e.g., unknown quantities).

Training 136A can include inputting the tool settings (e.g., TSn) for a section of well corresponding to actual build rate and/or actual turn rate values into build and/or turn rate equations, having an estimated or previously calculated set of model parameters (MP), to produce estimated build rate and estimated turn rate values 164 for that section of well. The estimated build rate and estimated turn rate values 164 can then be compared to the actual build rate and actual turn rate for that section of well 166. As the estimated turn and build rate values and actual turn and build rate values for that section of well are now known, the fit of the model can be determined by comparing the actual and estimated values, for example, by a standard sum of the square errors (SSE) calculation. If the SSE difference between the actual and estimated build and turn rate values does not exceed a desired value 168, the current model parameters can be used for another iteration, for example, for a subsequent section of well drilled with a subsequent set of tool settings. If the difference between the actual and estimated build and turn rate values exceed a desired value (also 168) and are thus deemed unacceptable, the model parameters can be adjusted to provide a better fit of the estimated build and turn rate values to the actual build and turn rate values. For example, the model parameters can be adjusted to minimize sum of the square errors (SSE) between the actual and estimated values. When the SSE is minimized for a section of well, one accepts the unknown parameters of the model are an optimal set of model parameters. The model parameters can be the set of values that minimizes the sum of the square errors (SSE) between the filtered build/turn curvature (produced in previous step 134A, for example) and the model build/turn curvature (produced by the build and turn rate equations). When the SSE is minimized, one can say that the model (e.g., build and turn rate equations with the corresponding set of model parameters) has captured the steering behavior of the BHA.

The methods and techniques provided herein can be used independently or in combination to control the trajectory of a directional well. Any of these methods can be combined to further increase the control. Numerous examples and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

What is claimed is:

1. A method of controlling the trajectory of a drill string comprising:

providing a steering behavior model of a bottom hole assembly in a borehole, the model having at least a build rate equation relating the build rate to tool settings or a turn rate equation relating the turn rate to tool settings;

determining a first estimated position of the bottom hole assembly by inputting a first tool setting into the steering behavior model;

comparing the first estimated position with a pre-existing well plan to obtain a variance; and utilizing a mathematical inverse of the steering behavior model to generate a second tool setting, the second tool setting being selected so as to correct the variance between the first estimated position and the pre-existing well plan.

2. The method of claim 1 further comprising calibrating the steering behavior model by minimizing any variance between an actual build rate and an actual turn rate of the bottom hole assembly generated by the first tool setting and a first estimated build rate and turn rate.

3. The method of claim 2 further comprising comparing the first estimated position to a well plan to determine any deviation of the bottom-hole assembly from the well plan.

4. The method of claim 3 wherein the second estimated position is closer to the well plan the first estimated position.

5. The method of claim 1 further comprising calibrating the steering behavior model by minimizing any variance between the actual build rate or the actual turn rate of the bottom hole assembly generated by the first tool setting and the first estimated build rate or the first estimated turn rate generated by inputting the first tool setting into the steering behavior model.

6. The method of claim 1 further comprising automatically generating a signal to a control means of the drill string to accomplish the second tool setting.

7. A method of controlling the trajectory of a drill string in a wellbore, the method comprising:

providing a steering behavior model having a build rate equation relating the build rate to tool settings or a turn rate equation relating the turn rate to tool settings;

calibrating the steering behavior model by minimizing any variance between an actual build rate or an actual turn rate of the drill string generated by a first tool setting and a first estimated build rate or a first estimated turn rate generated by inputting the first tool setting into the steering behavior model; and determining a second estimated build rate or a second estimated turn rate by inputting a second tool setting into the steering behavior model;

comparing the second estimated position with a pre-existing well plan to obtain a deviation of the drill string therefrom; and utilizing a mathematical inverse of the steering behavior model to calculate tool settings necessary to correct the deviation at the second estimated position, said calculations beginning at a previous point in the wellbore.

8. The method of claim 7 further comprising automatically transmitting the recommended tool setting to a component in the drill string.

9. The method of claim 7 wherein the calibrating step further comprises adjusting a model parameter of at least one of the build rate equation and the turn rate equation to minimize the any variance.

10. The method of claim 7 wherein the tool setting is selected from the group consisting of weight on bit, mud flow rate, rotational speed of the drill string, rotational speed of a drill bit, toolface angle, steering ratio, and drilling cycle.

11. A method of controlling the trajectory of a drill string in a wellbore, the method comprising:

providing a steering behavior model having a build rate equation relating the build rate to tool settings and a turn rate equation relating the turn rate to tool settings of a bottom-hole assembly;

providing an actual azimuth and inclination at a first interval of drilling;

determining an actual build rate and an actual turn rate at the first interval;

calibrating the steering behavior model by minimizing any variance between the actual build rate and the actual turn rate and a first estimated build rate generated by inputting a first set of tool settings into the steering behavior model; and determining a second estimated build rate and a second estimated turn rate with the calibrated steering behavior model for a subsequent second interval drilled with a subsequent second set of tool settings;

computing mathematical integrals of the build rate equation and the turn rate equation over the subsequent second interval to obtain corresponding inclination and azimuth equations from which a second estimated inclination and azimuth for the second interval are obtained;

computing mathematical integrals of the inclination and azimuth equations over the second interval to produce an estimated position of the bottom-hole assembly;

comparing the second estimated position with a pre-existing well plan to obtain a deviation of the drill string therefrom; and utilizing an inverse of the steering behavior model to calculate tool settings necessary to correct the deviation at the second estimated position, said calculations beginning at a previous point in the wellbore.

12. The method of claim 11 further comprising:

providing an actual azimuth and inclination data set for the second interval drilled with the second set of tool settings; and further calibrating the steering behavior model by minimizing any variance between the actual build rates and turn rates of the first and subsequent second intervals and the first and second estimated build rates and the estimated turn rates generated by inputting the first and second sets of tool settings into the calibrated steering behavior model.

13. The method of claim 11 wherein the build rate equation and the turn rate equations comprise at least one of drilling parameters, drilling tool settings, position and orientation of the drill string, properties of the formation, geometry of the bottom-hole assembly, and model parameters.

14. The method of claim 11 wherein the at least one of the build rate equation and the turn rate equation has a model parameter and further wherein the calibrating step further comprises adjusting the model parameter of at least one of the build rate equation and the turn rate equation to minimize the any variance.

* * * * *